United States Patent [19]

Hundley

[11] Patent Number: 4,462,295

[45] Date of Patent: Jul. 31, 1984

[54] BEAM AND CYLINDER SOUND INSTRUMENT

[76] Inventor: Craig R. Hundley, 14244 Valley Vista Blvd., Sherman Oaks, Calif. 91423

[21] Appl. No.: 409,985

[22] Filed: Aug. 20, 1982

Related U.S. Application Data

[63] Continuation-in-part of Ser. No. 195,433, Oct. 9, 1980, abandoned.

[51] Int. Cl.[3] ..... G10H 3/00

[52] U.S. Cl. ..... 84/1.16; 84/1.15; 84/292; 84/DIG. 21

[58] Field of Search ..... 84/1.16, 184, 292, 1.15, 84/DIG. 21, 312 P

[56] References Cited

U.S. PATENT DOCUMENTS

| | | | |
|---|---|---|---|
| 853,686 | 5/1907 | Feather et al. | 84/294 |
| 3,069,954 | 12/1962 | Lover et al. | 84/1.16 |
| 3,073,202 | 1/1963 | Evans | 84/1.16 |
| 3,405,585 | 10/1968 | Vagias | 84/1.16 |
| 3,519,721 | 7/1970 | Martin et al. | 84/1.16 |
| 4,170,917 | 10/1979 | Wheelock | 84/312 P |

*Primary Examiner*—Forester W. Isen

*Attorney, Agent, or Firm*—Auzville Jackson, Jr.

[57] ABSTRACT

A sound producing instrument is shown having a plurality of vibrating strings supported over an elongated aluminum sounding board. The strings are solid wires of brass, bronze or steel that are tensioned to produce a range of vibrations within the audible sound range. The strings may be manipulated along their lengths in various ways to control the mode of vibration of each of the respective strings. An electronic means such as a crystal or magnetic microphone is provided adjacent to the sounding board to pick up the vibrations resulting from activating the vibratory motion of the strings, and amplifying means are used to reproduce the sounds developed by the instrument. In one embodiment, the microphone may be caused to move during the pickup by a remote controller, so as to provide different sound effects. A special cylinder is provided for creating special sound effects when used to agitate the strings.

In a modification, cylindrical elements may be used when placed in contact with the strings to alter the vibratory action of the strings. The cylinders are formed of aluminum and may be manipulated in various ways to stimulate the motion of the respective strings in characteristic modes for the production of unusual sounds.

12 Claims, 6 Drawing Figures

BEAM AND CYLINDER SOUND INSTRUMENT

This application is a continuation-in-part of my copending application Ser. No. 195,433 filed Oct. 9, 1980, now abandoned.

BRIEF DESCRIPTION OF THIS INVENTION

A generally channel shaped aluminum beam having a substantial length forms a sounding board element for an instrument for producing sound. Steel, brass, or bronze wires are stretched over the flat web of the beam and are supported by bridges above the surface of the web. The strings are solid wire elements and may be tensioned to cover a sound range from just below the piano range up through the treble staff. Electrical microphone means are mounted on the web to pick up the vibrations produced by manipulating the strings in various ways for producing electrical impulses that may be amplified to produce unusual sound effects.

The strings may be caused to vibrate in various ways by being plucked, bowed, fretted, double fretted, digital massage agitated with cylindrical means applied thereto, and activated in various ways to initiate vibratory action in the strings. The combination of vibratory motions imparted to the sounding board through the bridges activates crystal or other known magnetic pick-up means that cooperate with conventional amplifying components to effect sounds ranging from the crash of artillery shells to gigantic musical crescendos and other new and unusual sounds in between.

In a preferred embodiment, the pick-up is mounted on a small moving car whose direction and rate of movement is controlled remotely at the same time the instrument is being played.

IN THE DRAWINGS

DETAILED DESCRIPTION

Figure 1:
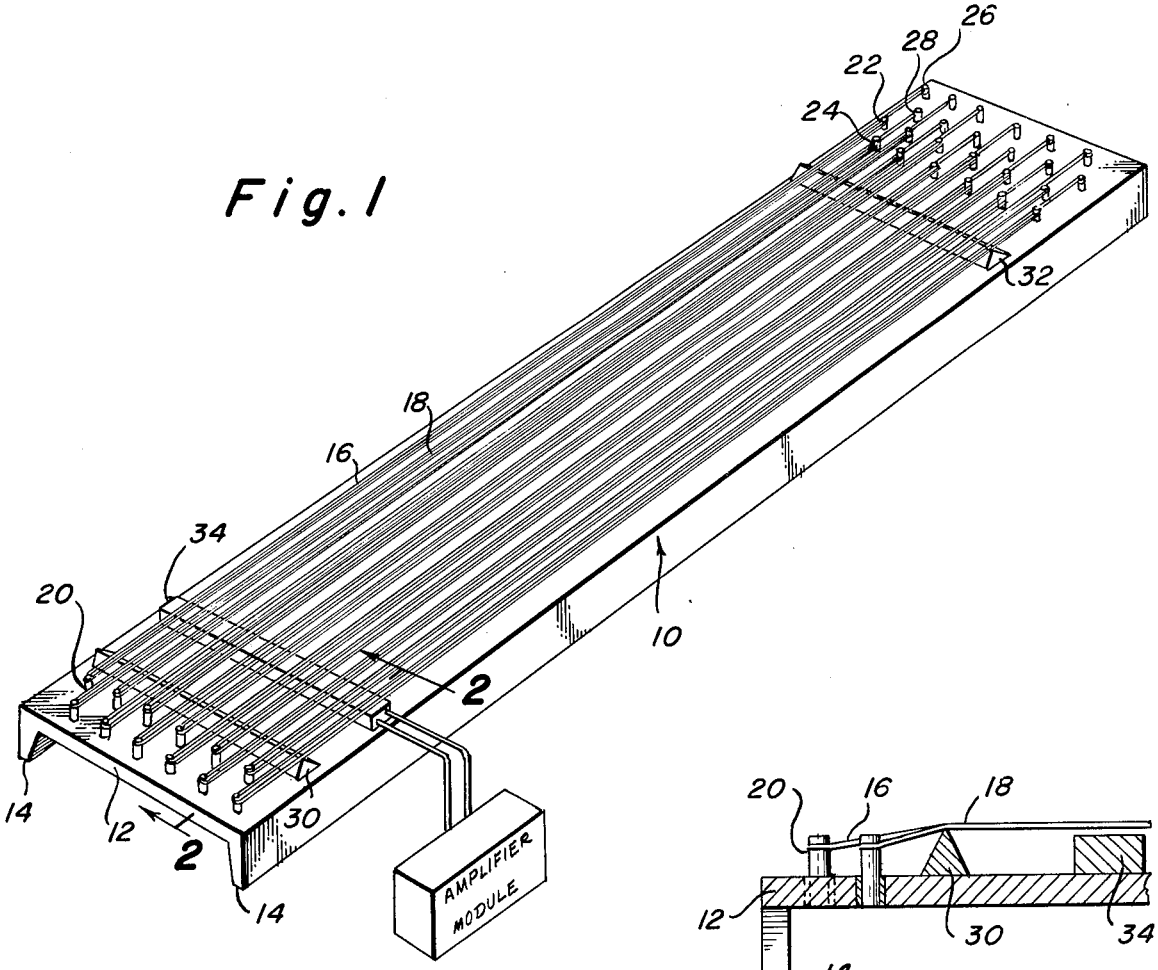
FIG. 1 is a perspective showing a first embodiment of the sounding board with the strings stretched over the board.

The instrument makes use of an aluminum sounding board 10 over which strings are stretched. The sounding board of FIG. 1 takes the form of a channel-shaped beam having a length of seventeen feet and a minimum width of nine inches, with a preferred width of ten inches. The beam is thus very long and has a very high length to width ratio. The beam may vary in length between 12 and about 22 feet and not less than nine inches in width for most of its length. The beam is an extruded aluminum shape and has a web 12 that is flat on the top as represented in FIG. 1 and has legs 14 to stiffen the channel.

Strings 16 and 18, etc. are stretched over the top of web 12, each string being anchored at its midpoint on fixed support 20 and the two legs of the U-shaped strings being attached to the holding and tensioning means 20 and 22 respectively. The separate legs of string 16 may be individually tensioned in the known manner, to tune each leg of string 16, for example, as desired. Similarly, string 18 and all the other strings, twelve in all, are mounted over the web to be fixed supported at one end on supports 20 with the individual legs of each string, such as strings 16, being attached to pegs 22 and 24, the legs of string 18 being attached to pegs 26 and 28, etc. A total of twelve strings are used over the sounding board to provide twenty-four differently tuned leg elements of the respective strings.

The twelve fixed supports 20 provided at one end of the sounding board may be permanently fitted in apertures formed in web 12. The midpoint of each individual string can be removably attached to its respective support 20 in any manner to hold it tight, while the string is mounted on the instrument so that its separate legs may be tensioned with a different degree of pull to produce a different vibratory motion in each of the several strings.

Figure 2:
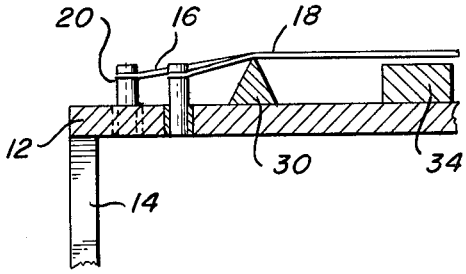
FIG. 2 is an end view of the sounding board of FIG. 1 showing the string tensioning means.

The pegs 22, 24, 26 and 28, etc. are similarly mounted in apertures in web 12, and as shown in FIG. 2, shoulders may be provided around such apertures to provide for an extended frictional engagement with these pegs so that they may be adjustably rotated to tighten or tension each leg of the respective wires carried on each individual peg and then fixedly held in adjusted position. As is known in tuning a piano string, for example, each string may be tensioned to produce a characteristic mode of vibration.

The strings are made of solid brass, bronze or steel wires, and between the fixed supports 20 and tensioning pegs 22 and 24, for example, all of the legs of the strings are supported on bridge means 30 and 32. The bridges are triangular elements made of acrylic resin to support the strings about an inch and one half above the surface of the web 12. The bridges are each spaced about seven inches from their respective ends of the sounding board.

Twelve strings are supported over the apex of each of the triangular bridges set to vibrating in various ways to agitate the sounding board. The composite vibrations transmitted from the legs of strings, through the bridges 30 and 32 supported on web 12, are picked up with suitable known crystal or magnetic microphone means 34 to be converted to electrical wave energy. The pick-up means is connected by suitable leads to a known amplifier module and audio frequency output means.

Figure 5:
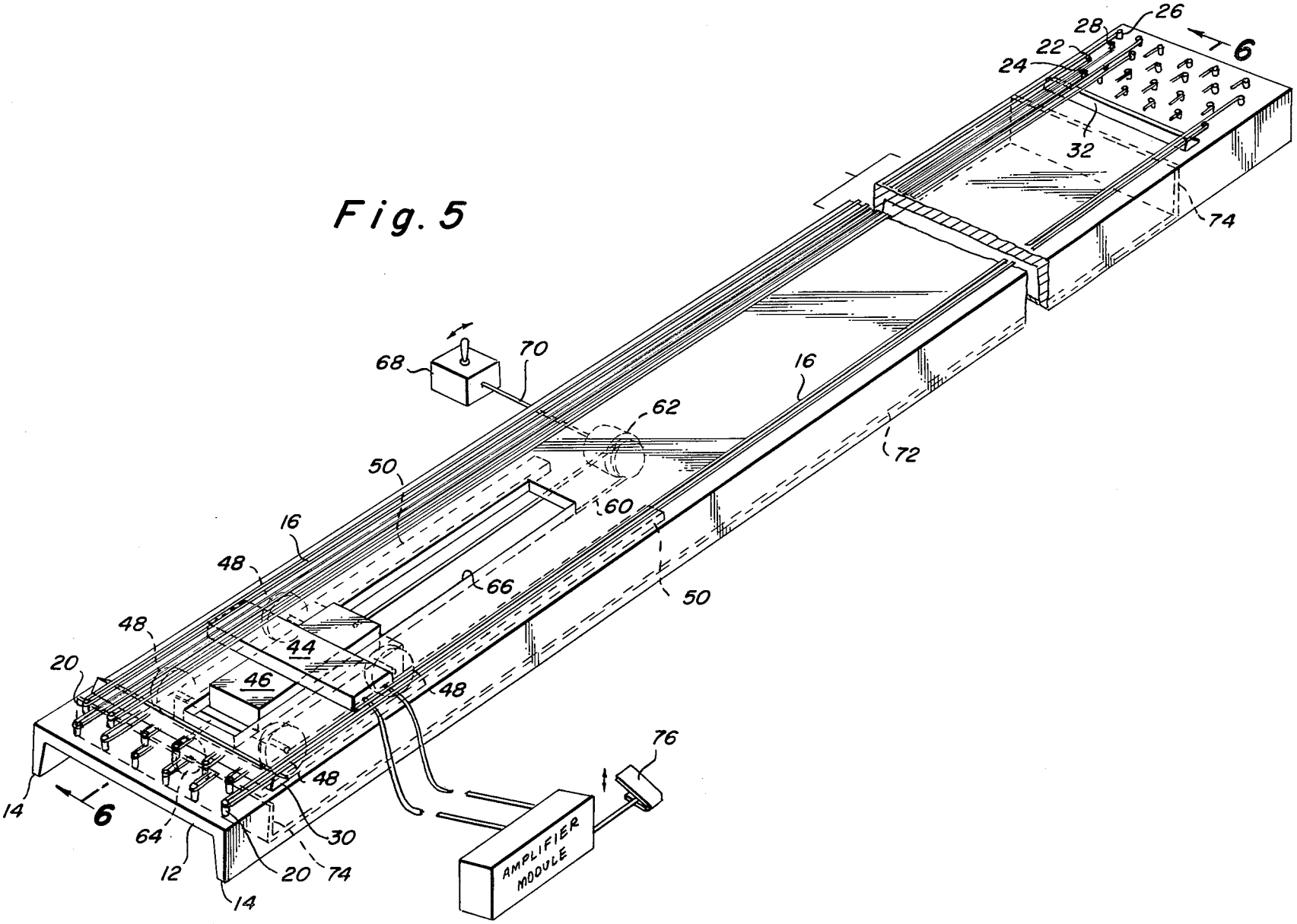
FIG. 5 is a perpective showing a second and preferred embodiment of the instrument.
Figure 6:
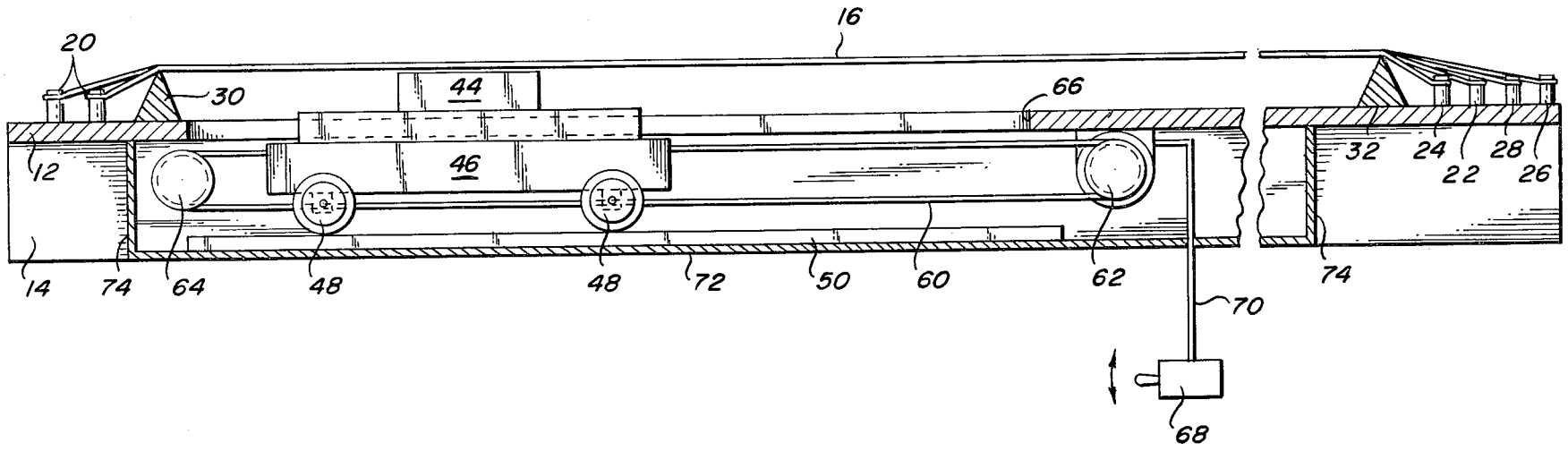
FIG. 6 is a cross-section of FIG. 5.

The preferred embodiment is shown in FIGS. 5 and 6, wherein like numbers are used for those features in common with FIGS. 1 and 2. The preferred embodiment is fourteen feet long, twelve inches wide and three inches high. The bridge means 30 and 32 are one and three-fourths inches high, three inches wide and ten inches long. The principal difference between the first embodiment of FIGS. 1 and 2 and the preferred second embodiment is the provision of a movable pickup 44 and a reflector panel 72.

The beam web 12 is provided with an opening 66 near one end. The opening 66 is located centrally athwart the width of the web and is three inches wide and twenty-three inches long. Its outboard end is eight and one-half inches from the nearest end of the beam.

Underneath the instrument is welded a reflector box made from a thin aluminum sheet. The reflector box has a bottom reflector panel 72 and two reflector end walls 74. The reflector box terminates inboard the ends of the instrument as seen in FIGS. 5 and 6. The panel 72 extends almost the entire length of the instrument and entirely across the width thereof. The end walls 74 completely enclose the opening between the panel 72, the beam legs 14, and the beam web 12. Thus, the bottom panel or reflector and end walls form an enclosed chamber to enhance the sound. A variation of the bottom reflector panel would be convexed downward instead of being flat.

A movable microphone pickup 44 is provided to ride within the boundaries of opening 66. The pickup is nine and one-half inches wide by three inches long and is preferably a known magnetic type. The pickup 44 is attached to and carried on the top of a movable car 46 having four wheels 48. The wheels ride on track 50 which are attached on the top of reflector panel 72. While the tracks 50 and wheels 48 are shown having a flat contacting surface, they may have mating surfaces which prevent the wheels from having any substantial sidewise movement. For example, the tracks could have a triangular cross-section and the wheels could have a mating tiangular groove.

It is to be noted from FIG. 6 that the movable car 46 protrudes through the opening 66 so that the top is slightly above the top of beam web 12. Also, the thickness of the microphone pickup is such that the top thereof rides just below the surface of strings 16 and 18. Thus, as the movable car 46 moves along tracks 50 carrying the microphone pickups, the pickup does not rub against either the strings 16 and 18 or the beam web 12.

The movable car 46 is caused to move by a drive belt 60 attached to both the front and rear thereof which passes over a drive sheave attached to a suitable variable speed reversible motor 62. Motors of this type are well known and readily available. The drive belt also passes around an idling sheave 64 after passing underneath the movable car 46 between the wheels thereof.

The motor 62 is controlled by a motor control switch 68 attached to the motor by a suitable connecting cable 70. The switch is of a kind readily available which is biased to a center-off position. When the switch is moved one direction, the motor causes the car to move in the same direction. When moved in the opposite direction, the motor and car move in the opposite direction. The more the switch is moved in a given direction, the faster the motor rotates. When the switch is released, it returns to an off position.

The foregoing arrangement permits the micrphone pickup to be moved during the play of the instrument so it sweeps the harmonic overtones. It can also be used by the musician to position the pickup to a desired location even if he does not choose to have it move while the instrument is played.

The microphone pickup 44 is connected through suitable wiring to a standard amplifier module which can be adjusted during play of the instrument by a standard type of musician's foot pedal 76.

The strings are tuned to vibrate in a range from below the lowest musical note on a piano up through the treble staff. By plucking or bowing the legs of the strings or double fretting one or more of the individual legs of the strings or using digital massage on the legs as they vibrate and otherwise individually or simultaneously agitating selected ones of the respective twenty-four legs of the strings, various sounds may be produced.

Figure 3:
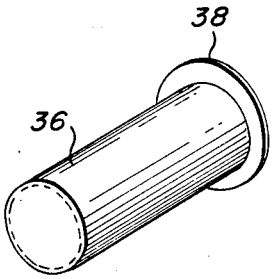
FIG. 3 is a perspective view of one type of cylindrical device.
Figure 4:
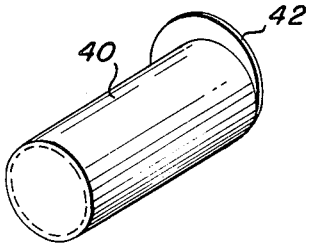
FIG. 4 is a perspective of a modified form of a cylindrical device that may be used with the stringed instrument.

As shown in FIGS. 3 and 4, cylindrical agitating means 36 and 40 may be provided to stimulate the vibrations of the strings. The cylinder 36 is formed as an aluminum tube about nineteen and three-eighths inches long and four and one-fourth inches in outer diameter. The bottom of the cylinder is closed, and the upper end has a collar 38 concentric with the outer wall, the collar being seven-eighths of an inch wide. The wall of the tube is three thirty-seconds of an inch thick, and the collar is one thirty-seconds of an inch thick.

The cylinder 40 shown in FIG. 4 may be smaller and has a collar 42 somewhat differently attached to the body of the cylinder. This cylinder may be fifteen and one-quarter inches long and two and seven-eighths inches in outer diameter. In this form of the cylinder, the collar may be circular or some other generally circular shape, but it is to be noted that the collar and cylinder are assembled in a non-concentric pattern, rather eccentrically. The cylinder 40 and collar 42 are formed of aluminum having a thickness the same as described above with respect to cylinder 36 and collar 38.

In use, the selected cylindrical means 36 or 40 may be applied over the instrument to engage one or more of the legs of the strings. These cylinders may be either rolled over the strings, or hammered, or a bow may be drawn over the edge of either collar 38 or 42 to agitate the legs of the strings in contact with the cylinder to produce vibrations in the sounding board. The collar 42 provides even more variety in its sound producing capacity in combination with this stringed instrument when the bow is moved from place to place around the periphery of the collar as it is drawn over the collar of this cylinder means.

A plurality of pickup means may be applied to the surface of the sounding board and various electronic amplification, and speaker means may be used in conjunction with the sound generating device. By proper variation of the manner of initiating the vibration of one or all of the legs of the strings to produce the relatively unlimited combination of vibratory motions that may be generated on more or less of the twenty-four legs of the strings mounted on the sounding board here disclosed, a means is provided to produce a multiplicity of unusual sound effects ranging from utter noise to beautiful musical notes or chords.

In use, the beam is supported on the apex of two triangular supports to be held at a convenient height so that the legs of the strings may be manipulated in various ways by the person using the instrument.

The legs of the strings may be plucked like a guitar; vibrated with a bow by depressing certain legs below the level of the legs or legs being vibrated by the bow; the strings may be fretted and even double fretted to produce more than one variety of vibrations from an individual leg or group of the legs being activated; and the legs may be digitally massaged to produce tremolos, harmonics, sliding spounds and the like. The variety of the resulting complex vibratory output that can be accomplished by the proper manipulation of the instrument described above, together with the use of the cylindrical units applied to the strings, enables one to create a wide variety of unusual, eerie and beautiful sounds that can be amplified and recorded.

The above described two embodiments of the new musical instrument and two cylindrical agitating means for use therewith. The new musical instrument is made substantially entirely of aluminum. It is understood the term aluminum includes the alloys thereof. Also, the instrument is seen to have a very high length to width ratio and is very long being in the order of 17 feet and about 12 to about 22 feet. It will be appreciated by one skilled in the art that many variations may be made in various details without departing from the spirit of the invention as set forth in the following claims.

I claim:

1. An instrument for producing sound effects made substantially entirely of aluminum, comprising an elongated flat topped beam, said beam having a web and integral side legs with the cross-section shape being substantially the same throughout most of the beam's length, a plurality of string supports at one end of said beam and a cooperating plurality of string holding and tensioning means at the other end of said beam, a plurality of strings formed of solid wire, each string respectively being stretched from said supports at said one end of the beam to said holding and tensioning means at said other end of said beam, separate bridge means at each end of said beam for holding said strings spaced above said web, said holding and tensioning means including means to individually adjust the tension of each of said respective strings, a hollow aluminum cylindrical tube means closed at one end and having a collar integral with its other end, said tube means being in contact with said strings to produce sound effects, and means including a pick-up between said web and said strings that is responsive to vibratory motion produced from time to time in certain combinations or the individual ones of said strings to produce various kinds of audible sound effects.

2. An instrument as in claim 1 wherein said beam is at least about twelve feet long and is a minimum of nine inches wide, said bridges holding said strings spaced at least one inch above said web.

3. An instrument as in claim 2 wherein said beam is formed of an extruded aluminum shape.

4. An instrument as in claim 3 wherein said bridges are spaced inwardly from the ends of said beam about seven inches.

5. An instrument as in claim 4 wherein there are twelve string supports at said one end of the beam and twenty-four string holding and tensioning means are disposed at said other end.

6. An instrument as in claim 1 wherein said collar is thinner than the wall of said cylinder.

7. An instrument as in claim 1 wherein said collar is eccentrically disposed relative to said cylindrical tube.

8. An instrument as in claim 1 wherein said cylinder is at least fifteen inches long.

9. An instrument as in claim 1 wherein said collar is circular and is concentrically disposed relative to the cylindrical tube.

10. An instrument for producing sound effects made substantially entirely of aluminum, comprising an elongated flat topped beam, said beam having a web and integral side legs with the cross-section shape being substantially the same throughout most of the beam's length, said web having an opening therein, a plurality of string supports at one end of said beam and a cooperating plurality of string holding and tensioning means at the other end of said beam, a plurality of strings formed of solid wire, each string respectively being stretched from said supports at said one end of the beam to said holding and tensioning means at said other end of said beam, separate bridge means at each end of said beam for holding said strings spaced above said web, said holding and tensioning means including means to individually adjust the tension of each of said respective strings, means including a pick-up between said web and said strings that is responsive to vibratory motion produced from time to time in certain combinations or the individual ones of said strings to produce various kinds of audible sound effects, a movable car projecting through said web opening and carrying said pick-up, and a reversible and variable speed drive means for causing said car and pick-up to move while said instrument is being played.

11. An instrument as set forth in claim 10 wherein a reflector panel is affixed to the bottom thereof between said side legs.

12. An instrument as set forth in claim 11 wherein said instrument is between about 12 feet and about 22 feet in length and greater than 9 inches in width.

* * * * *